US005402326A

United States Patent [19]

Belliveau

[11] Patent Number: 5,402,326

[45] Date of Patent: Mar. 28, 1995

[54] GOBO HOLDER FOR A LIGHTING SYSTEM

[75] Inventor: Richard S. Belliveau, Austin, Tex.

[73] Assignee: High End Systems, Inc., Austin, Tex.

[21] Appl. No.: 151,393

[22] Filed: Nov. 12, 1993

[51] Int. Cl.[6] ..... F21V 17/00

[52] U.S. Cl. ..... 362/284; 362/283; 362/293; 362/324; 362/455; 359/813; 359/889

[58] Field of Search ..... 359/813, 814, 889, 891, 359/811; 362/268, 282, 283, 284, 293, 319, 322, 324, 440, 455, 456, 433

[56] References Cited

U.S. PATENT DOCUMENTS

| | | | |
|---|---|---|---|
| 1,027,848 | 5/1912 | Huston | 362/440 |
| 2,146,637 | 2/1939 | MacFadden | 362/433 |
| 2,205,179 | 6/1940 | Schultz | 359/889 |
| 2,214,050 | 9/1940 | Fowler | 362/268 |
| 3,702,929 | 11/1972 | Burch | 362/268 |
| 4,392,187 | 7/1987 | Bornhorst | 362/233 |
| 4,460,943 | 7/1984 | Callahan | 362/276 |
| 4,597,643 | 7/1986 | Podvin et al. | 359/889 |
| 4,709,311 | 11/1987 | Bornhorst | 362/277 |
| 4,891,738 | 1/1990 | Richardson | 362/282 |
| 4,914,556 | 4/1990 | Richardson | 362/293 |
| 5,009,488 | 4/1991 | Fay et al. | 359/889 |
| 5,113,332 | 5/1992 | Richardson | 362/282 |
| 5,198,939 | 3/1993 | Hewett | 359/233 |

FOREIGN PATENT DOCUMENTS

| | | | |
|---|---|---|---|
| 508849 | 7/1953 | Belgium | 359/889 |
| 0511829 | 4/1992 | European Pat. Off. . | |
| 2327567 | 1/1974 | Germany | 359/813 |
| 369786 | 4/1932 | United Kingdom | 362/455 |

*Primary Examiner*—Ira S. Lazarus
*Assistant Examiner*—Alan B. Cariaso
*Attorney, Agent, or Firm*—James R. Bell; Stuart J. Friedman

[57] ABSTRACT

A gobo holder for a lighting system is provided which includes a housing for removably receiving a gobo therewithin, the housing having first and second ends and being positioned in the beam of light such that light enters the housing through the first end, passes through the gobo and exits the housing through the second end, a support on the housing for supporting the gobo in the housing, the support being positioned such that the beam of light passing through the gobo is unobstructed by the support, and a spring retainer supported by the housing and in contact with and resiliently biasing the gobo into contact with the support, the spring retainer being positioned such that the beam of light passing through the gobo is unobstructed by the spring retainer. The gobo holder is particularly advantageous in that it is capable of securely retaining gobos of various thicknesses in position during use while permitting easy and quick replacement of the gobos during lighting operations.

14 Claims, 3 Drawing Sheets

GOBO HOLDER FOR A LIGHTING SYSTEM

TECHNICAL FIELD

The present invention relates to a lighting system for stage, theater, architectural and display illumination and, more particularly, to a lighting system including means for mounting and retaining selected gobos in a beam of light.

BACKGROUND OF THE INVENTION

Conventional lighting systems for stage, theater, architectural and display illumination include means for removably inserting various types of optical beam modifiers into the light beam to vary the color, intensity, size, shape and pattern of the beam. Thus, in a typical system, a light source produces white light which is passed, for example, through at least one dichroic filter color wheel for producing a colored light beam, a gobo wheel for imposing a selected pattern on the light beam, a light intensity wheel for varying the intensity of the light transmitted therethrough, a mechanical iris for determining beam size and a lens system for controlling light beam focus and divergence. U.S. Pat. No. 4,392,187—Bornhorst discloses several such systems.

For imposing a desired pattern on the light beam it is well known to pass the beam through a gobo, which is a template or light stencil having a predetermined pattern. Typically, gobos are formed by chemically etching the desired pattern onto stainless steel discs. The discs are supported in the projected light beam to impose upon the light passing therethrough the pattern which has been etched into the discs. It is well known, for example, from U.S. Pat. No. 4,460,943—Callahan to provide a mounting plate having a plurality of equally spaced apertures arranged around a common axis for mounting gobos within one or more of the openings. The plate is drivingly rotatable, as via a motor, about its axis to insert a selected gobo into the beam of light. U.S. Pat. No. 4,891,738—Richardson et al discloses a similar arrangement including an apertured gobo mounting plate which is rotatably driven by motor driven rollers frictionally engaging the peripheral edge of the plate. The gobos are mounted on or within holders which, in turn, are positioned within the plate apertures. The mounting plate is rotatably driven to position a selected gobo within the beam of light. In this position a motor-operated holder drive mechanism acts, through frictional contact with the rim of the holder, to rotatably drive the gobo holder in either direction at any desired speed. In this manner the plate is rotatable to position a selected gobo within the beam of light and the gobo holder is rotatable to spin the gobo holder within the beam of light. Similar functions are achieved with the gobo wheel disclosed in European Patent Application Publication No. 0 511 829 A2 in which each of a plurality of gobo holders has gear means associated with it which engages a central sun gear for simultaneously rotatingly driving all of the gobo holders.

Most typically, gobos are mounted directly, or indirectly via gobo holders, to gobo plates by spring clips. Frequently, the spring clips take the form of cantilevered spring fingers or tabs which have been formed from or affixed to the mounting plate at 120 degree intervals around the gobo. The fingers define, with the mounting plate surface, a predimensioned space into which gobos of specified thicknesses may be inserted and securely held by the spring fingers. Since most stainless steel gobos are very thin, having a thickness in the range of 2 to 10 mils, the use of spring clips having a predetermined small clearance with the plate has proven to be a reasonably effective way for mounting gobos. Recently, however, it has been found that gobos having better pattern resolution than the thin stainless steel gobos and which do not warp with heat, as do the stainless steel gobos, can be prepared by chemically etching metal coatings, such as aluminum or nickel coatings, formed on glass substrates. Due to the thickness of the glass substrates, the resulting high pattern resolution gobos have thicknesses which are up to 10 to 15 times the thickness of conventional stainless steel gobos and will not fit into the spring clips which have been dimensioned for the considerably thinner stainless steel gobos. For the same reason, gobo wheels having spring clips designed to accept the thicker glass substrate gobos cannot securely hold the thinner stainless steel gobos. This inability to securely retain thin stainless steel gobos and thicker glass substrate gobos in the same apparatus has caused and will continue to cause a serious problem in the entertainment lighting industry. As a result, there is a serious need for a gobo holder which has the ability to accept and securely hold, in a manner allowing ease of insertion, quick release and rapid interchange, gobos having a wide variety of thicknesses.

SUMMARY OF THE INVENTION

It is, therefore, an object of the invention to provide a gobo holder which is capable of securely and releasably holding gobos which have a variety of thicknesses.

It is another object of the invention to provide a lighting system including a light source projecting a beam of light, means for mounting one or more gobos and means for positioning a selected one of the mounted gobos in the beam of light, the means for mounting including resilient means for accommodating gobos having a wide variety of thicknesses, whereby the gobos are easily insertable into and readily removable from the mounting means to facilitate rapid interchange of gobos.

In one aspect of the invention a lighting system is provided which includes:

(a) a light source for projecting a beam of light;

(b) means for mounting one or more gobos;

(c) means for positioning a selected one of said gobos in the beam of light;

(d) said mounting means comprising (i) a housing for removably receiving a gobo therewithin, said housing having first and second ends and being positioned in said beam of light such that light enters said housing through said first end, passes through said gobo and exits said housing through said second end, (ii) a support means on said housing for supporting said gobo in said housing, said support means being positioned such that said beam of light passing through said gobo is unobstructed by said support means, and (iii) spring retaining means supported by said housing and in contact with and resiliently biasing said gobo into contact with said support means, said spring retaining means being positioned such that the beam of light passing through said gobo is unobstructed by said spring retaining means, whereby said gobo has a predetermined thickness and said spring retaining means securely retains said gobo in said housing independent of said predetermined thickness.

In another aspect of the invention a gobo holder for a lighting system having a light source for projecting a beam of light is provided comprising:

(a) a housing for removably receiving a gobo therewithin, said housing having first and second ends, (b) a support means on said housing for supporting said gobo in said housing, and (c) spring retaining means supported by said housing and in contact with and resiliently biasing said gobo into contact with said support means, whereby said spring retaining means securely retains said gobo in said housing.

BRIEF DESCRIPTION OF THE DRAWINGS

The invention will be better understood from a consideration of the detailed description thereof taken in conjunction with the following drawings, in which.

DETAILED DESCRIPTION OF THE INVENTION

Figure 1:
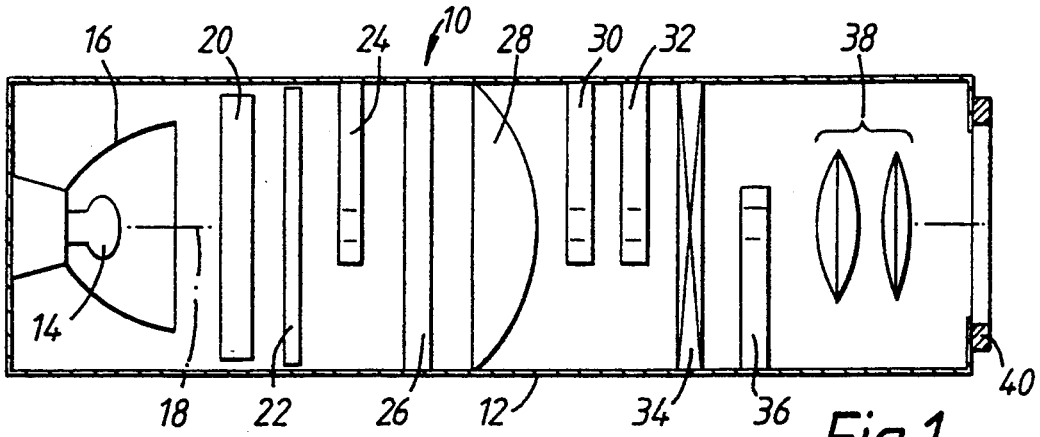
FIG. 1 is a schematic elevational view of a typical lighting system incorporating the gobo holder of the present invention.

The present invention is embodied in a unique means for mounting gobos utilizing resilient means for accommodating gobos having a wide variety of thicknesses. The gobo holder of the present invention may be used in a wide variety of lighting systems, such as the system illustrated in FIG. 1.

A remotely controllable fixture 10 mounted within an elongate, generally cylindrical fixture housing 12 includes a light source for producing white light, such as MSR Series arc lamp 14. An ellipsoidal reflector 16 is positioned around arc lamp 14 to reflect any light which is directed other than generally parallel to optical axis 18. The light beam emanating from the lamp/reflector assembly is incident on heat filter 20 which, desirably, comprises a glass substrate onto which dichroic infrared and ultraviolet wavelength reflecting layers are deposited for passing light in the visible spectrum and reflecting infrared and ultraviolet energies.

The color and intensity of the light beam is customized, as desired, by passage of the visible light sequentially through color mixing plate 22 and motor-operated color wheel 24 which is rotatably mounted about an axis generally parallel to the path of light travel. Color wheel 24 comprises a plurality of window apertures distributed about its outer periphery. All but one of the apertures has a dichroic filter mounted therein for permitting a single color of light to be transmitted therethrough. By modifying the white light passing through the color mixing plate 22 to user desirable colors and providing a selection of dichroic filters in color wheel 24, a broad spectrum of colors are available for the light which exits color wheel 24.

The color customized light passes to a stepper motor-operated shutter 26, functioning as an on/off light control, which may be operated between a closed position, which allows no light to pass, and an open position, which permits all incident light to pass. In this way, rapid operation of the stepper motor permits shutter 26 to create a strobe effect. After passing power lens 28, wherein the divergence of the beam is adjusted, the pattern of the light is modified by passage through motor-operated rotating gobo wheel 30, as more fully described hereinafter, and motor-operated fixed gobo 32. The latter is a single, drivingly rotatable wheel having multiple patterns etched therein and distributed about its outer periphery. Motor operated iris 34, by extending or contracting in known manner, increases or decreases beam size before the beam encounters motor operated effects wheel 36 which includes appropriate inserts mounted in peripherally distributed window apertures for creating desired modifying effects on the beam, such as altering beam pattern, color or diffusion, creating a prismatic effect, and the like. Finally, the light beam passes through one or more lenses 38 for providing a zoom effect and adjusting beam focus and/or divergence prior to exiting fixture housing 12. At the fixture exit frost flag plates 40 finally adjust the focus of the beam to the desired level of sharpness.

Figure 2:
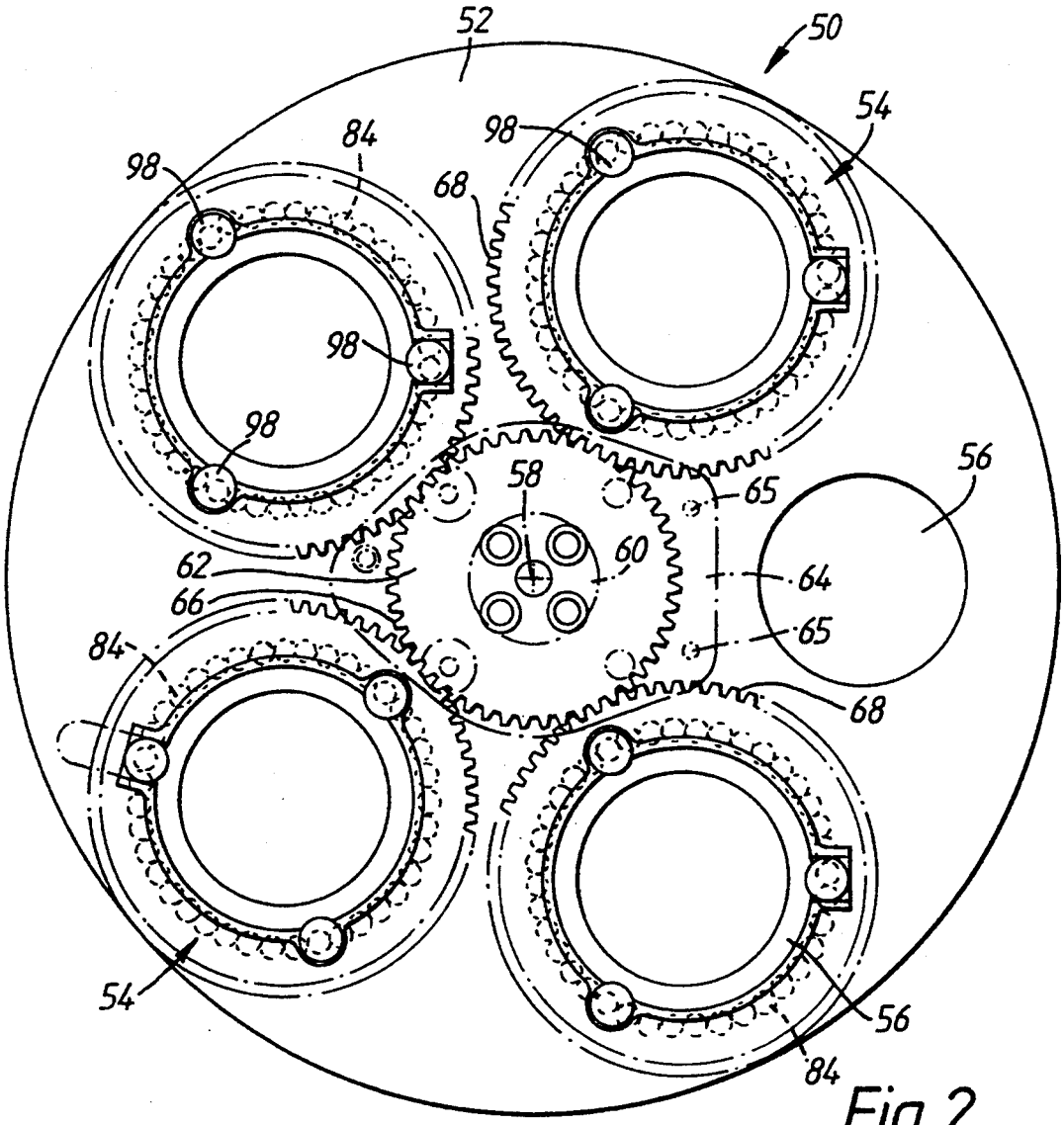
FIG. 2 is a plan view of one form of a rotatable gobo wheel assembly which can be used in the lighting system of the present invention.

As shown in FIG. 2, a typical rotatable gobo-wheel assembly indicated generally at 50 includes a circular gobo baseplate 52 for supporting a plurality of gobo holders 54. As shown, baseplate 52 includes five (5) apertures 56 extending therethrough and positioned around, and equally spaced from, a central axis 58 of baseplate 52 for receiving a respective gobo holder 54. Baseplate 52 also includes a central hub 60 extending outwardly from one surface of baseplate 52 for attachment to a rotatable shaft of a motor (not shown) for rotating baseplate 52 to position one of the gobo holders 54 in the beam of light.

A mounting plate 64 attached via legs 65 to baseplate 52 supports a gear motor (not shown) having a rotatable shaft (not shown) on which a driving pinion gear 62 is rotatably mounted. In this manner, mounting plate 64 and the associated gear motor rotate with the entire gobo baseplate 52 while being operable to rotate pinion gear 62 independent of the rotation of baseplate 52. In a typical fashion, pinion gear teeth 66 formed on the peripheral edge of pinion gear 62 engage complimentary gear teeth 68 formed on the outer periphery of each gobo holder 54 for rotating the gobo holders upon rotation of pinion gear 62.

Figure 3:
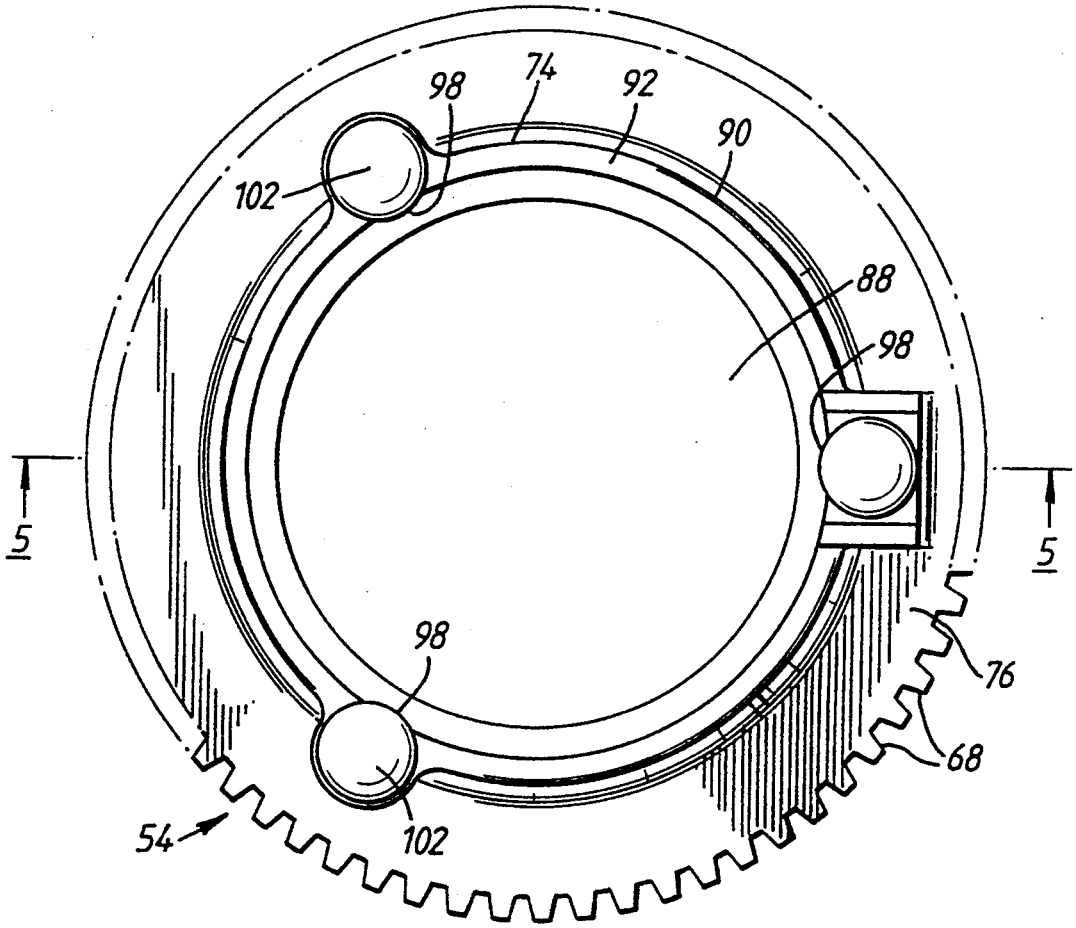
FIG. 3 is a plan view of the gobo holder of the present invention.
Figure 4:
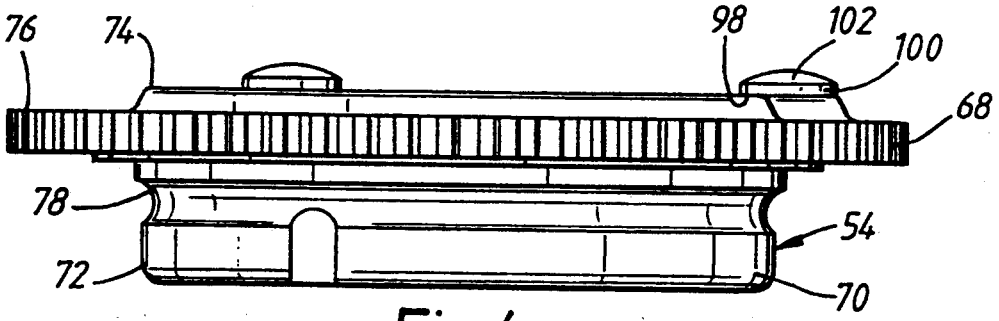
FIG. 4 is a front elevational view of the gobo holder of the present invention.
Figure 5:
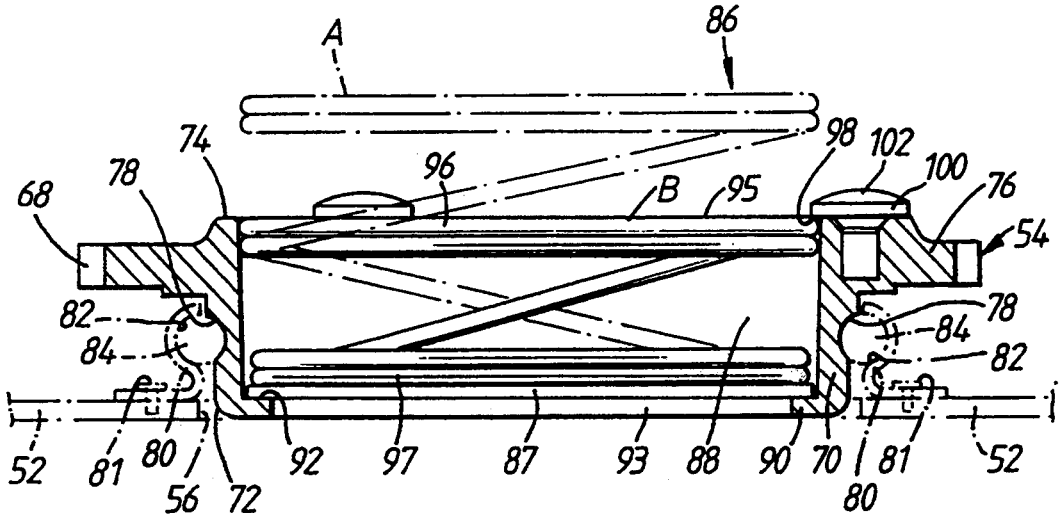
FIG. 5 is a cross-sectional view taken along line 5—5 in FIG. 3.

Referring to FIGS. 3 through 5, the rotatable gobo holder 54 of the present invention includes a cylindrical portion 70 having an inner end 72 and an outer end 74, and an annular ring 76 formed integrally with cylindrical portion 70 and extending radially outward from portion 70 between inner end 72 and outer end 74. Gear teeth 68 are formed on the outer periphery of ring 68 around its entire circumference. As shown in FIG. 5, inner end 72 of cylindrical portion 70 is positioned in aperture 56 of baseplate 52 so as to permit gobo holder 54 to rotate relative to baseplate 52. Relative rotation between baseplate 52 and gobo holder 54 is partially achieved by providing an annular groove 78 in the outer surface of cylindrical portion 70 between annular ring 76 and inner end 72. A ting-like raceway 80 is positioned around aperture 56 and attached to baseplate 52 by any conventional fastening means, such as poprivets 81 or screws. Raceway 80 extends outwardly from baseplate 52 towards annular ring 76 to form an inner annular groove 82 adjacent annular groove 78 of gobo holder 54. As shown in FIGS. 2 and 5, a plurality of ball bearings 84 rotatably positioned in inner annular groove 82 engage annular groove 78 to securely position inner end 72 of gobo holder 54 within aperture 56 while permitting gobo holder 54 to rotate relative to baseplate 52.

As shown in FIGS. 3 through 5, gobo holder 54 also includes a retaining means indicated generally at 86 for securely, yet replaceably, retaining a gobo 87 within the cylindrical bore 88 formed by cylindrical portion 70. Retaining means 86 includes an annular rim 90 formed integrally with cylindrical portion 70 at inner end 72 and extending radially inward to form an annular land 92 facing bore 88. Annular land 92 functions to support gobo 87 in cylindrical bore 88. Rim 90 also defines an opening 93 which permits light to pass through cylindrical bore 88 and gobo 87.

Retaining means 86 also includes a bias spring 96, e.g., a coil spring, positionable in cylindrical bore 88 so as to securely retain gobo 87 against annular land 92. Spring 96 includes an outer end 95, and an inner end 97 positioned in cylindrical bore 88 in abutting contact with the outer annular surface of gobo 87. Inner end 97 is formed with a flat surface so as to increase the surface contact area between inner end 97 and gobo 87, thereby increasing the frictional holding force against gobo 87 far minimizing the possibility of movement of gobo 87 relative to holder 54 during use.

Retaining means 86 also includes three (3) abutment surfaces in the form of three (3) overhangs 98 which extend from outer end 74 of cylindrical portion 70 radially inward for contact by outer end 95 of bias spring 96. As best shown in FIG. 5, each overhang 98 is formed by an overhanging edge of a washer 100 secured to outer end 74 of gobo holder 54 by a rivet 102. Washer 100 is sized and positioned to create overhang 98 which extends into cylindrical bore 88 a sufficient distance so as to provide an adequate surface for secure abutment by outer end 95 of bias spring 96 without extending into the beam of light passing through opening 93. Likewise, the inner diameter of bias spring 96 is greater than the diameter of opening 93 formed by annular rim 90 so as to assure unobstructed passage of the light beam through gobo holder 54.

During use, gobo 87 is inserted into bore 88 and positioned against annular land 92. Inner end 97 of bias spring 96 is then positioned in cylindrical bore 88 against gobo 87 while outer end 95 extends outward of cylindrical bore 88 into the position indicated in phantom at A. Outer end 95 of bias spring 96 is then forcibly compressed and pushed passed overhangs 98 into cylindrical bore 88. The outer end of bias spring 96 is then released into the spring position indicated at B to abut overhangs 98 thereby securing gobo 87 in position within gobo holder 54. When it is desired to remove or replace gobo 87, bias spring 96 is simply slightly flexed so that its outer end moves past at least one overhang 98 and out of cylindrical bore 88. Bias spring 96 may then be flexed again, or shifted, and moved away from the remaining overhangs 98 and out of bore 88. Inner end 97 of bias spring 96 has a smaller diameter than outer end 95 so that once the outer end has been moved past overhangs 98 out of bore 88, the remainder of spring 96 may be more easily removed without catching on overhangs 98. This tapered design of spring 96 also permits inner end 97 to be easily moved passed overhangs 98 into position against gobo 87.

The gobo holder 54 of the present invention is particularly advantageous in that it is capable of securely retaining gobos of various thicknesses in position during use while permitting easy and quick replacement of the gobos during lighting operations. It is also advantageous because bias spring 96 exerts circumferential pressure around the entire periphery of gobo 87 to hold the periphery of gobo 87 flat against annular land 92. This is important for stainless steel gobos which, due to their thinness tend to warp and lift their edges when held by only three spring clips, as is presently conventional. In addition, although gobo holder 54 has been described herein in connection with a rotating gobo assembly it will be appreciated that its advantages are equally applicable to a stationary gobo assembly.

I claim:

1. A lighting system comprising:

(a) a lighting source for projecting a beam of light;

(b) means for mounting at least one gobo;

(c) means for positioning a selected gobo in the beam of light;

(d) said mounting means comprising (i) a housing for removably receiving a gobo therewithin, said housing having first and second ends being positioned in said beam of light such that light enters said housing through said first end, passes through said gobo and exits said housing through said second end, (ii) a support means on said housing for supporting said gobo is said housing, said support means being positioned such that said beam of light passing through said gobo is unobstructed by said support means, (iii) Said housing and support means including a cup-shaped member having an inner circumferential wall defining a cylindrical space, the first end having an annular land defining an aperture in the member and the second open end including an overhang;

(iv) a resilient member removably mounted in the cylindrical space in a compressed position between the gobo and the overhang, whereby the gobo is removably retained adjacent the first end: and (v) the overhang including retainer means for retaining the resilient member in the compressed position, the retainer means being secured to the second end by a plurality of fasteners.

2. A gobo holder for a lighting system having a light source for projecting a beam of light comprising:

(a) a housing for removably receiving a gobo therewithin, said housing having first and second ends and being positioned in said beam of light such that light enters said housing through and first end, passes through said gobo and exits said housing through said second end, (b) a support means on said housing for supporting said gobo in said housing, said support means being positioned such that said beam of light passing through said gobo is unobstructed by said support means, (c) said housing and support means including a cup-shaped member having an inner circumferential wall defining a cylindrical space the first end having an annular land defining an aperture in the member and the second open end including an overhang;

(d) a resilient member removably mounted in the cylindrical space in a compressed position between the gobo and the overhang, whereby the gobo is removably retained adjacent the first end; and (e) the overhang including retainer means for retaining the resilient member in the compressed position, the retainer means being secured to the second end by a plurality of fasteners.

3. A gobo holder comprising:

a tubular member defining an open space therein and including first and second open ends;

an annular land positioned at the first open end;

an overhang positioned at the second open end, both the annular land and the overhang protruding into the space defined within the tubular member;

removable resilient means retained in a compressed position within the tubular member between the annular land and the overhang for urging a gobo into engagement with the annular land, whereby the gobo is removably retained within the tubular member; and the overhang including a plurality of washers each secured to the second end by a respective fastener, the washers and fasteners being positioned around the annular periphery of the second end.

4. The gobo holder as defined in claim 3, and further including:

gear teeth formed on an outer surface of the tubular member.

5. The gobo holder as defined in claim 4, and further including:

a baseplate including an aperture formed therein, the tubular member being rotatably mounted within the baseplate aperture.

6. The gobo holder as defined in claim 5 wherein the tubular member is bearing mounted in the baseplate.

7. The gobo holder as defined in claim 6, and further including:

a pinion gear mounted in the baseplate, the pinion gear drivingly engaged with the gear teeth on the tubular member.

8. The gobo holder as defined in claim 7 wherein the baseplate is rotatable.

9. A gobo holder as defined in claim 8, and further including:

additional tubular members, similar to said tubular member mounted in the baseplate.

10. A gobo holder comprising:

a tubular member defining an open space therein and including first and second annular open ends;

an annular land positioned at the first open end;

an overhang positioned at the second open end, the annular land and the overhang protruding into the space defined within the tubular member;

a gobo mounted in the tubular member, an annular peripheral portion of the gobo being in engagement with the annular land;

a removable resilient member retained in a compressed position within the tubular member between the gobo and the overhang, whereby the gobo is removably retained adjacent the first end of the tubular member; and the overhang including a plurality of fasteners secured around the annular periphery of the second end, the fasteners securing retainer means to the second end for retaining the resilient member in the compressed position.

11. A rotatable gobo wheel assembly comprising:

a rotatable baseplate including at least one aperture formed therein;

a tubular member defining an open space therein and including first and second open ends, the tubular member rotatably mounted in the aperture;

an annular land positioned at the first open end;

an overhang positioned at the second open end, both the annular land and the overhang protruding into the space defined within the tubular member;

resilient means removably retained in a compressed position within the tubular member between the annular land and the overhang for urging a gobo into engagement with the annular land, whereby the gobo is removably retained adjacent the first end; and the overhang including retainer means for retaining the resilient member in the compressed position, the retainer means being secured to the second end by a plurality of fasteners.

12. A gobo holder comprising:

a cup-shaped member having an inner circumferential wall defining a cylindrical space, a first end having an annular land defining an aperture in the member and a second open end including an overhang;

a disk-shaped gobo having an annular peripheral edge engaged with the annular land;

a resilient member removably mounted in the cylindrical space in a compressed position between the gobo and the overhang, whereby the gobo is removably retained adjacent the first end; and the overhang including retainer means for retaining the resilient member in the compressed position, the retainer means being secured to the second end by a plurality of fasteners.

13. The gobo holder as defined in claim 12, and further including:

first means formed in an outer circumferential wall of the retainer for bearing mounting the retainer for rotation in an associated support.

14. The gobo holder as defined in claim 13, and further including: second means formed in the outer circumferential wall of the retainer for being rotatably driven relative to the support.

* * * * *